US006039285A

United States Patent [19]

Biagiotti

[11] Patent Number: 6,039,285

[45] Date of Patent: Mar. 21, 2000

[54] DEVICE FOR UNWINDING REELS OF WEB MATERIAL COMPRISING A SYSTEM FOR CONTROLLING THE UNWINDING PRESSURE

[75] Inventor: Guglielmo Biagiotti, Lucca, Italy

[73] Assignee: Fabio Perini S.p.A., Lucca, Italy

[21] Appl. No.: 08/930,759

[22] PCT Filed: Apr. 16, 1996

[86] PCT No.: PCT/IT96/00074

§ 371 Date: Oct. 8, 1997

§ 102(e) Date: Oct. 8, 1997

[87] PCT Pub. No.: WO97/07609

PCT Pub. Date: Feb. 27, 1997

[30] Foreign Application Priority Data

Apr. 21, 1995 [IT] Italy ..... FI950044 U

[51] Int. Cl.[7] ..... B65H 16/10; B65H 23/185

[52] U.S. Cl. ..... 242/563; 242/563.2; 242/564.5

[58] Field of Search ..... 242/563, 563.2, 242/564.5, 595.1, 547, 541.3, 420.2, 420.1, 420.5

[56] References Cited

U.S. PATENT DOCUMENTS

| | | | |
|---|---|---|---|
| 1,268,134 | 6/1918 | White | 242/564.5 |
| 1,967,056 | 7/1934 | Horton | 242/420.2 |
| 2,090,858 | 8/1937 | Anderson et al. | 242/564.5 |
| 2,984,429 | 5/1961 | Huck | 242/564.5 |
| 3,202,376 | 8/1965 | Dutro et al. | 242/564.5 |
| 3,471,097 | 10/1969 | Phelps | 242/541.3 |
| 3,740,296 | 6/1973 | McDonald | 242/564.5 |
| 3,989,201 | 11/1976 | Cottrell . | |
| 4,632,325 | 12/1986 | Feyerl et al. | 242/564.5 |
| 4,736,605 | 4/1988 | Klockner et al. | 242/547 |
| 4,883,233 | 11/1989 | Saukkonen et al. . | |
| 5,275,345 | 1/1994 | Stahl et al. | 242/547 |
| 5,326,041 | 7/1994 | Alexander, III et al. . | |

FOREIGN PATENT DOCUMENTS

| | | |
|---|---|---|
| 0321887 | 6/1989 | European Pat. Off. . |
| 445034 | 1/1926 | Germany . |
| 1088339 | 9/1960 | Germany . |
| 793937 | 4/1958 | United Kingdom . |

*Primary Examiner*—John M. Jillions
*Attorney, Agent, or Firm*—Breiner & Breiner

[57] ABSTRACT

A device is described for unwinding a reel of web material in order to feed said material to a processing section, comprising a support (1) for the reel (B), an unwinding member and an actuator (21) which applies a pressure on the reel, causing said unwinding member to press thereon; means are also provided for adjusting the pressure applied to the reel via said unwinding member (17) as a function of the diameter of the reel being unwound, the pressure being reduced as the diameter decreases.

12 Claims, 1 Drawing Sheet

DEVICE FOR UNWINDING REELS OF WEB MATERIAL COMPRISING A SYSTEM FOR CONTROLLING THE UNWINDING PRESSURE

DESCRIPTION

1. Technical Field

The invention relates to a device for unwinding a reel of web material in order to feed said material to a processing section, comprising a support for the reel, an unwinding member for unwinding said reel, and pressure means which causes said unwinding member to press on said reel, wherein the pressure applied on said reel varies with the diameter of said reel being unwound, 2. Background Art An unwinding device of the above mentioned kind is disclosed in EP-A-0 321 887. This known device includes an arm on which an unwinding belt is supported. The position of the arm changes during unwinding, according to the diameter of the reel. The position of the arm with respect to the reel is such that the pressure exerted by the unwinding belt on the reel decreases when the diameter of the reel decreases.

Unwinding devices of this type are commonly used in paper processing lines, in which a reel of large diameter is formed into reels of smaller diameter, equal to the diameter of the finished product, which are then cut perpendicularly to their axis to produce rolls of toilet paper, kitchen towels and similar products.

Usually, the unwinding member in these unwinding devices is an endless flexible member that travels around a plurality of pulleys, at least one of which is motorized. The pulleys are carried by a movable arm. In some cases to the arm an actuator is attached which causes one part of the flexible member to press against the outer surface of the reel. Typically, the flexible member is a belt or a plurality of belts. However, it is quite possible for the unwinding member to take a different form, for example a rotating cylinder. In such a case, said rotating cylinder can still be carried by a movable arm which is operated by the actuator.

The diameter of the reels varies greatly during operation, from the starting diameter (2000–3000 mm) down to the diameter of the inner tubular core (about 80–450 mm). The pressure exerted by the unwinding member must be carefully gaged in order to prevent it exceeding the strength limits of the reel as the latter's diameter decreases, especially when the force exerted by the unwinding device is added to the weight of the reel, that is to say when the unwinding device presses on the reel from above. If the reel were to break during the operating phase, this would cause a considerable loss in production and loss of raw materials, and would pose a great danger to personnel. On the other hand, too low a pressure would give rise to difficulties in controlling the unwinding action during the initial phase and during changes in speed.

SUMMARY OF THE INVENTION

The subject of the present invention is an unwinding device of the type indicated at the outset that makes it possible to avoid the risk of incorrectly gaging the unwinding pressure applied to the reel and makes it easier to set the device, ensuring correct operation with reels of any diameter and at any stage of the unwinding cycle.

Basically, these and other objects and advantages—which will be quite evident to those skilled in the art on reading the following description—are achieved by providing, in combination with the unwinding device, an actuator which controls the pressure of the unwinding means on the reel and diameter detection means for adjusting the pressure applied to the reel as a function of the diameter of the reel being unwound, the pressure being reduced as the diameter decreases.

A transducer for detecting the diameter of the core is preferably provided. However, this is not strictly necessary, as will be explained below, since the diameter might be detected indirectly. If this transducer means is present, it could take the form of a position transducer which detects the position of the movable arm carrying said pulleys for deflecting the flexible member. It could also take the form of a cam profile solid to the arm carrying the unwinding means and directly controlling a proportional valve which causes a variation in the pressure applied.

Within the context of the present description and the attached claims, a detection means for detecting the diameter of the reel might be also represented by a means which detects the number of intermittent lowering steps of the arm carrying the unwinding means, assuming the diameter of the reel is reduced by a known amount each time the arm is lowered. In this case, the diameter is detected indirectly by the detection means.

In a way known per se, said movable arm may carry an actuator that keeps said flexible member taut while the movable arm is moved step-wise (that is to say in an intermittent manner) toward the axis of the reel, as the latter is unwound, and each time said actuator has reached a predetermined position.

BRIEF DESCRIPTION OF THE DRAWINGS

The drawing shows one possible embodiment of the invention. In the drawing.

DETAILED DISCLOSURE OF THE INVENTION

Figure 1:
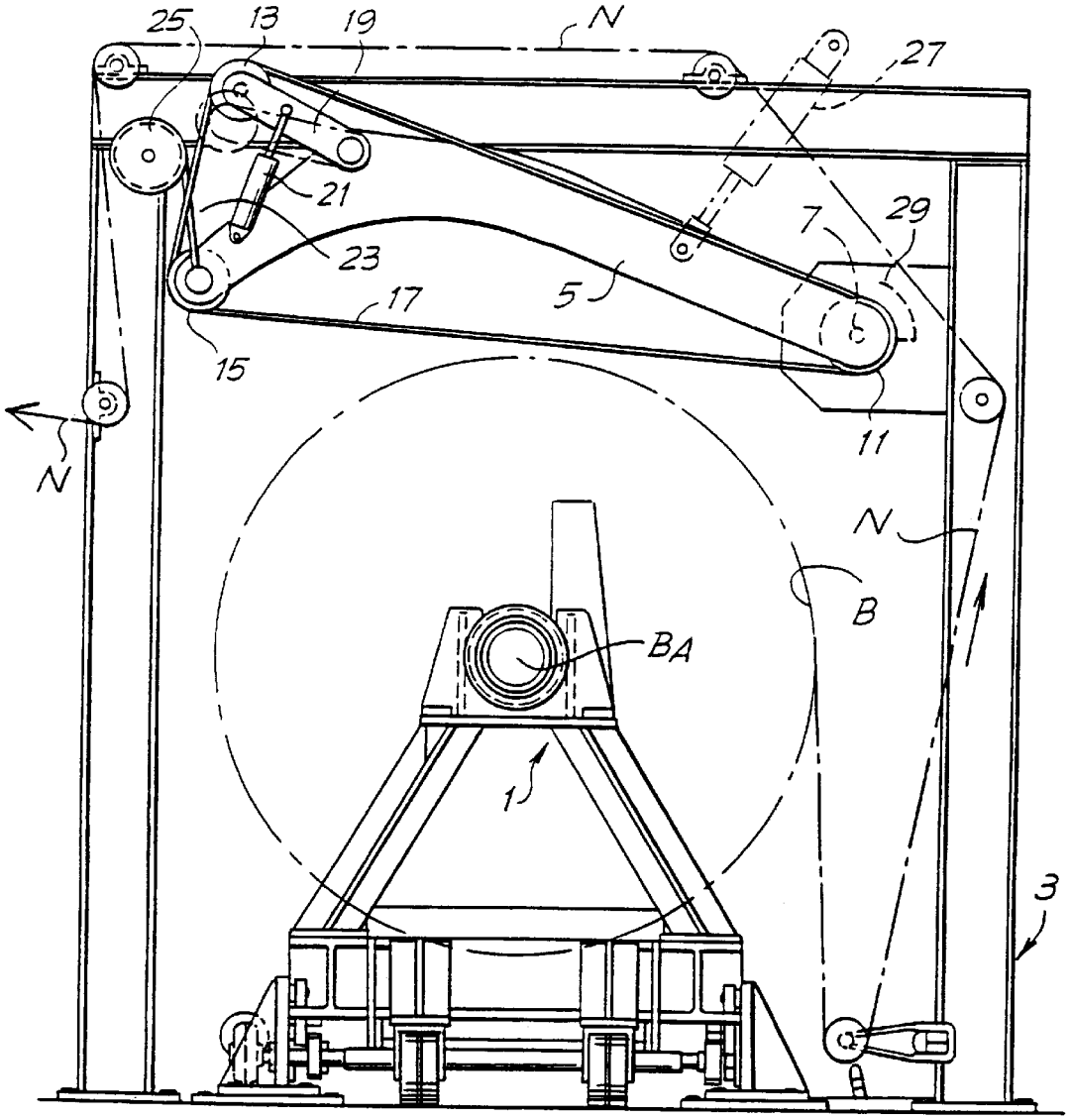
FIG. 1 shows a side view of the unwinding device.

The unwinding device comprises a support 1 for the reel B of web material N which is unwound and fed to a processing line (not shown). A housing 3 carries a movable arm 5 which is hinged at 7 about a stationary horizontal axis so that it can rotate toward the axis BA of the reel B. The movable arm 5 carries three pulleys 11, 13, 15, at least one of which (for example the pulley 11) is motorized. Travelling around the pulleys 11, 13, 15 is a flexible member consisting of a belt 17 which is brought into contact with the cylindrical surface of the reel B and pressed against it in order to exert the pressure required to unwind it.

One of the deflection pulleys of the belt 17, pulley 13 in the example illustrated, is carried by a smaller auxiliary arm 19 to which is attached a cylinder and piston actuator 21, for the purposes detailed below.

The movable arm 5 is held in its angular position by a cable 23 and a pulley block 25 or by a cylinder and piston actuator 27 or by other equivalent means designed to move the movable arm 5 downward at predetermined instants, so as to follow the reduction in diameter of the reel B.

In order to unwind the reel B, the movable arm 5 is lowered with respect to the position it occupies in FIG. 1, until the belt 17 comes into contact with the outer surface of the reel B over a sufficiently extensive arc, and exerting a sufficiently high pressure, to ensure that enough frictional force is exerted on the reel to cause it to rotate. The belt 17 is kept taut by the cylinder and piston system 21. By rotating the belt 17 the reel is also made to rotate and the web material N is gradually fed to the processing line downstream. This causes a gradual reduction in the diameter of the reel B and hence an extension of the cylinder and piston 21 which constitutes an elastic system—with a consequent clockwise swinging movement of the smaller auxiliary arm 19, thereby tending to recover the slack in the belt 17.

Once the smaller auxiliary arm 19 has reached an end-of-travel position, for example determined by a position transducer, the actuator 27 or the system 25 designed to lower the movable arm 5 by rotating it counterclockwise about the axis 7, is operated. This once again involves compressing the cylinder and piston system 21.

Attached to the movable arm 5 is a position transducer consisting, for example, of an encoder or of a series of proximity sensors 29 which enable the angular position of the arm 5 to be detected and hence an approximate indication of the diameter of the reel B to be given.

Figure 2:
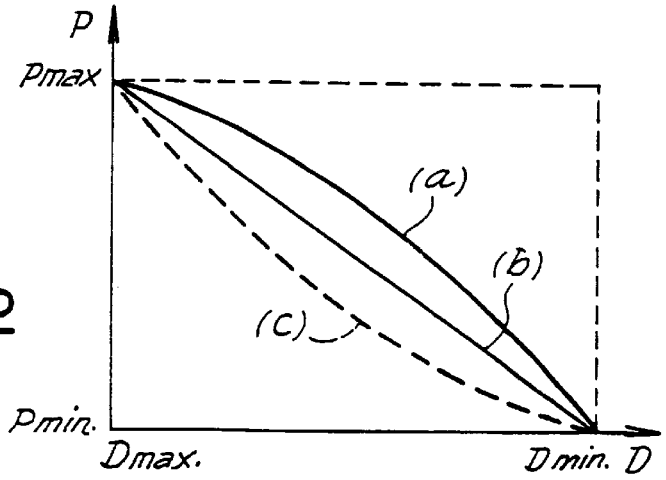
FIG. 2 shows a graph of the pressure on the reel as a function of its diameter.

During operation, at the beginning of the reel B unwinding cycle, said reel has a large diameter and therefore a large cross section. The belt 17 is pulled very taut by means of the cylinder and piston actuator 21 and therefore a large pressure is applied to the surface of the reel. As the diameter of the reel B decreases and the movable arm 5 is lowered in order to follow the variation in the diameter by rotating around the axis 7, the tension in the belt 17 and thus the pressure on the reel B are reduced. The reduction may be a linear one or may be defined in some other way. FIG. 2 shows a graph illustrating the pressure exerted on the reel B as a function of the diameter of the reel. Three different, alternative curves are shown: (a), (b) and (c). The graph is continuous, from a maximum pressure value Pmax, corresponding to the maximum diameter Dmax, to a minimum pressure value Pmin, corresponding to the minimum diameter Dmin. In practice, when an arrangement of the type shown in FIG. 1 is used, with an actuator 21 that takes up the slack in the belt 17 and a movable arm 5 that is lowered intermittently by means of the actuator 27 or the pulley block 25, the pressure exerted on the reel is discontinuous, but the situation is analogous in terms of concept: the pressure is gradually reduced as the diameter of the reel B decreases.

Rather than using a transducer to detect the position of the movable arm 5, means may be used which detect the actual diameter of the reel directly.

As an alternative, and given that the movable arm 5 preferably has an intermittent lowering movement, it is even possible to dispense with the position transducer altogether and vary the pressure on the reel as a function of the number of lowering movements effected by the arm 5, assuming the diameter of the reel is reduced by a known amount each time the arm is lowered.

Instead of detecting the position of the arm 5 using a transducer and therefore adjusting the pressure as a function of the signal from said transducer, the arm 5 can be provided with a cam profile that directly controls a proportional valve with a rod. In this way, as the arm 5 rotates it directly causes a variation in the pressure.

As the reel is unwound, it may be necessary to slow down the speed at which the web material is fed out, for example as a result of the re-winding device downstream being slowed down. In such cases it is necessary to brake the reel. In order to ensure efficient braking, it is possible for the pressure exerted by the unwinding member (for example the flexible member 17) to be temporarily increased, for example by a fixed percentage value, during the braking action and to be then once again reduced and brought back to the operating value determined by the diameter of the reel.

I claim:

1. A device for unwinding a reel of web material in order to feed said material to a processing section, comprising:

a support for the reel;

an unwinding member for unwinding said reel, said unwinding member having an unwinding cycle;

pressure applicator which causes said unwinding member to press on said reel, wherein pressure applied to said reel varies with diameter variation of said reel during unwinding, said pressure applicator including an actuator; and a detector for generating signals which are a function of a diameter of the reel;

wherein said unwinding cycle includes continuous driving of said unwinding member and continuous application of variable pressure to said reel by said pressure applicator when said unwinding member is in said unwinding cycle, said variable pressure being adjusted over time based on said signals from said detector to said actuator, said pressure being reduced as the diameter of the reel being unwound decreases.

2. The unwinding device of claim 1, wherein said detector includes a sensor for detecting said diameter.

3. The unwinding device of claim 1, wherein said unwinding member comprises an endless flexible member that moves around a plurality of pulleys carried by a movable arm, at least one of said plurality of pulleys is motorized, said actuator causing one part of said flexible member to press against said reel.

4. The unwinding device of claim 1, wherein said unwinding member is carried by a movable arm and the detector is a position sensor that detects a position of said movable arm.

5. The unwinding device of claim 1, wherein said unwinding member is carried by a movable arm constructed and arranged to cause, upon rotation of the movable arm, variation in pressure upon the reel being unwound.

6. The unwinding device as claimed in any one of claims 3, 4 or 1, wherein said pressure applicator increases pressure exerted during reel braking phases.

7. A device for unwinding a reel of web material in order to feed said material to a processing section, comprising:

a support for the reel, an unwinding member for unwinding said reel, pressure applicator which causes said unwinding member to press on said reel, a detector for generating a signal which is a function of a diameter of the reel, wherein said pressure applicator includes an actuator, pressure is applied by said actuator which is controlled by the signal of said detector, said pressure by said actuator being reduced as the diameter of the reel being unwound decreases;

wherein said unwinding member comprises an endless flexible member that moves around a plurality of pulleys carried by a movable arm, at least one of said plurality of pulleys being motorized, said actuator causing one part of said flexible member to press against said reel; and said actuator is carried by said movable arm and keeps said flexible member taut by applying to the flexible member a tension which is a function of the diameter of the reel.

8. A device for unwinding a reel of web material in order to feed said material to a processing section, comprising:

a support for the reel, an unwinding member for unwinding said reel, pressure applicator which causes said unwinding member to press on said reel, wherein pressure applied on said reel varies with diameter variation of said reel upon unwinding, said pressure applicator includes an actuator, a detector is provided for generating a signal which is a function of a diameter of the reel, pressure is applied by said actuator which is controlled by the signal of said detector, said pressure by said actuator being reduced as the diameter of the reel being unwound decreases;

wherein said unwinding member comprises an endless flexible member that moves around a plurality of pulleys carried by a movable arm, at least one of said plurality of pulleys being motorized, said actuator causing one part of said flexible member to press against said reel; and said actuator is carried by said movable arm and keeps said flexible member taut by applying to the flexible member a tension which is a function of the diameter of the reel; and said movable arm is moved step-wise toward an axis of the reel, as said reel is unwound, and each time said actuator has reached a predetermined position.

9. The unwinding device of either claim 7 or 8, wherein said detector includes a sensor for detecting said diameter.

10. The unwinding device as claimed in 9, wherein said pressure applicator increases pressure exerted during reel braking phases.

11. The unwinding device of claim 8, wherein said actuator is a cylinder and piston system that acts on an auxiliary arm carrying one of said plurality of pulleys, which pulley can move with respect to the other pulleys carried by said movable arm.

12. The unwinding device as claimed in either of claim 7, 8 or 11, wherein said pressure applicator increases pressure exerted during reel braking phases.

* * * * *

UNITED STATES PATENT AND TRADEMARK OFFICE

CERTIFICATE OF CORRECTION

PATENT NO. : 6,039,285
DATED : March 21, 2000
INVENTOR(S) : Guglielmo Biagiotti

It is certified that error appears in the above-identified patent and that said Letters Patent is hereby corrected as shown below:

Heading,

"[87] PCT Pub. No.: WO97/07609
PCT Pub. Date: Feb. 27, 1997"

Should read

-- [87] PCT Pub. No.: WO96/33120
PCT Pub. Date: Oct. 24, 1996 --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*